US008279142B2

(12) United States Patent
Seo et al.

(10) Patent No.: US 8,279,142 B2
(45) Date of Patent: Oct. 2, 2012

(54) METHOD FOR DRIVING PLASMA DISPLAY PANEL AND DISPLAY DEVICE

(75) Inventors: Yoshiho Seo, Miyazaki (JP); Koichi Sakita, Miyazaki (JP); Tadayoshi Kosaka, Miyazaki (JP); Hajime Inoue, Miyazaki (JP); Kazushige Takagi, Miyazaki (JP)

(73) Assignee: Hitachi, Ltd., Tokyo (JP)

( * ) Notice: Subject to any disclaimer, the term of this patent is extended or adjusted under 35 U.S.C. 154(b) by 530 days.

(21) Appl. No.: 12/090,373

(22) PCT Filed: Jan. 17, 2006

(86) PCT No.: PCT/JP2006/300544

§ 371 (c)(1),
(2), (4) Date: Mar. 30, 2009

(87) PCT Pub. No.: WO2007/083353

PCT Pub. Date: Jul. 26, 2007

(65) Prior Publication Data

US 2009/0262099 A1 Oct. 22, 2009

(51) Int. Cl.
*G09G 3/28* (2006.01)

(52) U.S. Cl. ..... 345/67; 345/60; 345/68; 345/204; 315/169.4

(58) Field of Classification Search ..... 345/60–72, 345/204; 315/169.3–169.4
See application file for complete search history.

(56) References Cited

U.S. PATENT DOCUMENTS

| | | | | |
|---|---|---|---|---|
| 5,745,086 | A | 4/1998 | Weber | |
| 7,145,524 | B2 | 12/2006 | Sakita | |
| 2002/0130823 | A1 | 9/2002 | Takayama | |
| 2003/0122740 | A1 | 7/2003 | Lee et al. | |
| 2003/0160742 | A1 | 8/2003 | Sakita | |
| 2003/0222835 | A1 * | 12/2003 | Yoon et al. | 345/60 |
| 2004/0046509 | A1 * | 3/2004 | Sakita | 315/169.3 |
| 2005/0225513 | A1 | 10/2005 | Jung et al. | |
| 2006/0125725 | A1 * | 6/2006 | Yang et al. | 345/67 |

FOREIGN PATENT DOCUMENTS

| | | |
|---|---|---|
| CN | 1441397 | 9/2003 |
| CN | 1677462 A | 10/2005 |

(Continued)

OTHER PUBLICATIONS

Chinese Official Communication dated Aug. 23, 2010 for corresponding Chinese patent application No. 200680038811.4.

*Primary Examiner* — Lun-Yi Lao
*Assistant Examiner* — Gene W Lee
(74) *Attorney, Agent, or Firm* — Antonelli, Terry, Stout & Kraus, LLP.

(57) ABSTRACT

A display device (1) including a surface discharge type plasma display panel (2) performs an addressing operation, a sustain operation and a reset operation. In the addressing operation, address discharge of an opposed discharge form with the second electrode (Y) used as a cathode is generated between the second electrode (Y) and a third electrode (A) in a cell to be energized or in a cell not to be energized. In the reset operation, an obtuse wave pulse (Pr1) having a negative polarity is applied to the second electrode (Y) so as to generate charge adjustment discharge starting from discharge of the opposed discharge form with the second electrode (Y) used as a cathode between the second electrode (Y) and the third electrode (A).

9 Claims, 11 Drawing Sheets

FOREIGN PATENT DOCUMENTS

| | | | |
|---|---|---|---|
| EP | 1 585 096 | A2 | 10/2005 |
| JP | 2002-278510 | | 9/2002 |
| JP | 2003-271092 | | 9/2003 |
| JP | 2003-271095 | | 9/2003 |
| JP | 2004-302134 | | 10/2004 |
| JP | 2005-292840 | | 10/2005 |

* cited by examiner

METHOD FOR DRIVING PLASMA DISPLAY PANEL AND DISPLAY DEVICE

TECHNICAL FIELD

The present invention relates to a method for driving a surface discharge type plasma display panel and a display device using the method.

BACKGROUND ART

A surface discharge type AC plasma display panel is used for displaying color pictures. The surface discharge type mentioned here has a structure in which first electrodes and second electrodes for generating display discharge are arranged in parallel on a front substrate or a rear substrate, and third electrodes are arranged so as to cross the first electrodes and the second electrodes. The display discharge determines light emission quantity of a cell that is a display element. In general, the first electrodes and the second electrodes are row electrodes that define rows of a matrix display while the third electrodes are column electrodes that define columns thereof. One of the first electrode and the second electrode (the second electrode in this description) is used as a scan electrode for row selection in addressing.

A typical surface discharge AC type plasma display panel has a cell structure as shown in FIG. 1. FIG. 1 shows a part including six cells corresponding to three columns of two rows, in which a front plate 10 and a rear plate 20 are separated for easy understanding of the internal structure.

The plasma display panel includes the front plate 10, the rear plate 20 and discharge gas (not shown). The front plate 10 includes a glass substrate 11, first row electrodes X, second row electrodes Y, a dielectric film 17 and a protection film 18. Each of the row electrodes X and the row electrodes Y is a laminate of a patterned transparent conductive film 14 and a metal film 15. The rear plate 20 includes a glass substrate 21, column electrodes A, a dielectric film 22, a plurality of partitions 23, a red (R) fluorescent material 24, a green (G) fluorescent material 25, and a blue (B) fluorescent material 26.

The row electrodes X and the row electrode Y are arranged alternately as display electrodes for generating surface discharge on the inner surface of the glass substrate 11 and are covered with the dielectric film 17 and the protection film 18. The dielectric film 17 is an essential element for the AC plasma display panel. The coating with the dielectric film 17 enables surface discharge to be generated repeatedly by utilizing wall charge accumulated in the dielectric film 17. The protection film 18 is made of a material that has good resistance to sputtering and a large secondary electron emission coefficient (in general, magnesia), and it has a function of preventing sputtering to the dielectric film 17 and a function of decreasing display discharge start voltage.

Since the plasma display panel reproduces a color display by a binary control of lighting, each of time sequence of frames $F_{k-2}$, $F_{k-1}$, $F_k$ and $F_{k+1}$ (hereinafter, subscripts indicating input orders are omitted) that are input images is divided into a predetermined number N of sub frames $SF_1$, $SF_2$, $SF_3$, $SF_4$, . . . $SF_{N-1}$ and $SF_N$ (hereinafter, subscripts indicating display orders are omitted) as shown in FIG. 2. In other words, each of the frames F is replaced with a set of N sub frames SF. These sub frames SF are assigned with luminance weights of $W_1$, $W_2$, $W_3$, $W_4$, $W_{N+1}$ and $W_N$ in turn. These weights of $W_1$, $W_2$, $W_3$, $W_4$, $W_{N-1}$ and $W_N$ define the number of times of display discharge in the individual sub frames SF. In accordance with this frame structure, a frame period Tf that is a frame transfer period is divided into N sub frame periods Tsf so that each of the sub frames SF is assigned with one sub frame period. In addition, the sub frame period is divided into a reset period for initialization (reset) of wall charge, an address period for wall charge control (addressing) in accordance with display data, and a sustain period for sustaining that generates the display discharge a plurality of times corresponding to luminance of a display to be lighted. The order of the reset period, the address period and the sustain period is the same among the N sub frames SF. The initialization, the addressing and the sustaining of wall charge are performed for each of the sub frames.

Furthermore, in case of an interlace display like a television display in which the frame is divided into a plurality of fields, each of the fields is replaced with a plurality of sub fields. In this case, the "frame" should be read as the "field" while the "sub frame" should be read as the "sub field". In addition, it is possible to divide the screen into a plurality of parts so that the reset, the addressing and the sustaining are performed individually for each of the parts.

As a related-art document about the drive sequence described above, there is Japanese unexamined patent publication No. 2004-302134. This publication discloses typical drive waveforms, which are shown in FIG. 3.

FIG. 3 shows waveforms for the row electrodes X and the column electrodes A as a whole, in which a waveform for the first row electrode Y(1) and a waveform for the last row electrode Y(n) are shown.

In the reset period, so-called obtuse wave reset is performed. In the obtuse wave reset, an obtuse wave pulse like a ramp waveform pulse shown in FIG. 3 is applied for generating feeble discharge successively, so that wall charge quantity is adjusted. A principle of the obtuse wave reset is described in detail in U.S. Pat. No. 5,745,086. In the illustrated obtuse wave reset, the obtuse wave pulse is applied two times. The first application of the obtuse wave pulse decreases a difference in wall voltage between a pre-energized cell and a pre-extinguished cell. The second application of the obtuse wave pulse equalizes wall voltages of all cells to be a set value. Here, the pre-energized cell is a cell that was energized in a sub frame preceding a noted sub frame, and the pre-extinguished cell is a cell except the pre-energized cell.

In the address period, a scan pulse is applied to each of the row electrodes Y one by one. In other words, the row selection is performed. In synchronization with the row selection, an address pulse is applied to the column electrode A corresponding to the cell to be energized in the selected row. Address discharge is generated in the cell to be energized that is selected by the row electrode Y and the column electrode A so that predetermined wall charge is formed there.

In the sustain period, a sustain pulse is applied to the row electrode Y and the row electrode X alternately. The display discharge is generated between the row electrodes of the cell to be energized (hereinafter, this is referred to as an interelectrode XY) by each application.

Hereinafter, the reset operation that is deeply connected to the present invention will be described more.

In the reset operation as shown in FIG. 3 in which the obtuse wave pulse is applied to each cell two times, it is desirable that a combination of forms of the two times of discharge should be a combination that will generate symmetric discharges, i.e., surface discharge and surface discharge or opposed discharge and opposed discharge. The surface discharge is generated on one side of a discharge gas space along the substrate surface. In the cell structure shown in FIG. 1, the surface discharge is generated by applying a voltage to the interelectrode XY. The opposed discharge is generated between electrodes sandwiching the discharge gas space in the thickness direction of the panel. The opposed discharge is generated by applying a predetermined voltage between the column electrode A and the row electrode Y (hereinafter, this is referred to as an interelectrode AY) or between the column electrode A and the row electrode X (hereinafter, this is referred to as an interelectrode AX).

However, in the combination of the opposed discharge and the opposed discharge, the column electrode becomes a cathode either in the first discharge or in the second discharge. Since a value of a secondary electron emission coefficient $\gamma$ of a fluorescent material covering the cathode is smaller than that of a protection film covering an anode, electron supply quantity by the fluorescent material is little. Therefore, the opposed discharge in which the column electrode becomes a cathode is apt to be unstable.

Therefore, a drive voltage in the reset period shown in FIG. 3 is set so that the discharge corresponding to each of the two times of application of the obtuse wave pulse starts from the surface discharge, i.e., that the reset operation of the combination of the surface discharge and the surface discharge is performed. Since the surface discharge generates priming particles in the discharge gas space, the opposed discharge can be generated easily. It depends on setting of the drive voltage whether the surface discharge starts and transfers to the combination discharge of the surface discharge and the opposed discharge or the discharge ends without generating the opposed discharge.

[Patent Document 1] Japanese unexamined patent publication No. 2004-302134

DISCLOSURE OF THE INVENTION

The obtuse wave pulse is applied for the purpose of generating the feeble discharge that changes the wall charge quantity gradually. Here, a ramp wave is exemplified as a typical obtuse wave. If a gradient of the ramp wave is steep, strong discharge will be generated so that the wall charge quantity cannot be adjusted to a desired value. In contrast, if the gradient of the ramp wave is sufficiently gentle, a pulse width of the obtuse wave pulse should be large for changing the wall charge quantity to be a desired value though the feeble discharge can be generated. Therefore, a turnaround time for the reset operation is increased. If the reset period is increased, time that can be assigned to the sustain period is decreased. As a result, luminance of the display is decreased.

An object of the present invention is to decrease a turnaround time for the adjustment of the wall charge quantity as a preprocess of the addressing operation.

A plasma display panel, for which the driving method for achieving the above-mentioned purpose is used, includes a first substrate and a second substrate that sandwich a discharge gas space in between the first substrate and the second substrate, first electrodes and second electrodes both arranged on the first substrate, a first insulator intervening between the first electrode and the discharge gas space as well as between the second electrode and the discharge gas space, third electrodes arranged on the second substrate, and a second insulator intervening between the third electrode and the discharge gas space. The first insulator emits secondary electrons more readily than the second insulator.

An experiment of changing a gradient of a ramp wave pulse (a rate of a voltage change) for generating discharge is carried out on the plasma display panel having the typical structure described above. The experiment showed that the discharge operation has tendencies (1) and (2) as follows.

(1) Even if the gradient is steep, strong discharge is less prone to be generated in the case where the discharge starts from the opposed discharge, compared to the case where the discharge starts from the surface discharge.

(2) Even if the discharge starts from the surface discharge, strong discharge is less prone to be generated in the case where a ramp wave pulse having a positive polarity is applied to the first electrode or the second electrode, compared to the case where a ramp wave pulse having a negative polarity is applied to the same.

More specifically, as to an example of a plasma display panel that can generate desired feeble discharge starting from the surface discharge by applying a ramp wave pulse having a negative polarity with a gradient of 1 V/μs or smaller, an upper limit of the gradient was 3 V/μs in the case where the feeble discharge starting from the surface discharge is generated by the ramp wave pulse having a positive polarity. Furthermore, in this plasma display panel, an upper limit of the gradient was 5 V/μs in the case where the feeble discharge starting from the opposed discharge is generated.

Concerning the tendency (1), the wall charge before the adjustment remaining at a position away from the electrode gap probably induces the strong discharge since the surface discharge expands from a vicinity of the electrode gap toward a far position. In contrast, the opposed discharge expands uniformly in the region where the electrodes are opposed, so that an offset of adjustment of the wall charge is hardly generated. Therefore, strong discharge is probably hardly generated in the opposed discharge.

Concerning the tendency (2), a potential of the third electrode has a negative polarity with respect to a potential of the first electrode or the second electrode when the ramp wave pulse having a positive polarity is applied. In this relationship between the potentials, strong discharge is probably hardly generated since there are few secondary electrons emitted from the second insulator disposed between the third electrode and the discharge gas space.

Based on the tendencies, it is advantageous to generate feeble discharge starting from the opposed discharge in order that the desired charge adjustment by the feeble discharge can be finished in a shorter time. In addition, if it is necessary to generate feeble discharge starting from the surface discharge, it is advantageous to generate the discharge by applying the obtuse wave pulse having a positive polarity to the first electrode or the second electrode.

The driving method for achieving the above-mentioned purpose includes the steps of performing an addressing operation that forms a state in which wall charge is accumulated that is necessary for energizing a cell to be energized, performing a sustaining operation that generates discharge between the first electrode and the second electrode in the cell to be energized, and performing a reset operation that forms a state in which wall charge of the first insulator in every cell is initialized. In the addressing operation, address discharge of an opposed discharge form is generated with the second electrode used as a cathode between the second electrode and the third electrode in a cell to be energized or a cell not to be energized, and in the reset operation, an obtuse wave pulse having a negative polarity is applied to the second electrode, so that charge adjustment discharge starting from the discharge of an opposed discharge form with the second electrode used as a cathode is generated between the second electrode and the third electrode.

BEST MODE FOR CARRYING OUT THE INVENTION

Figure 1:
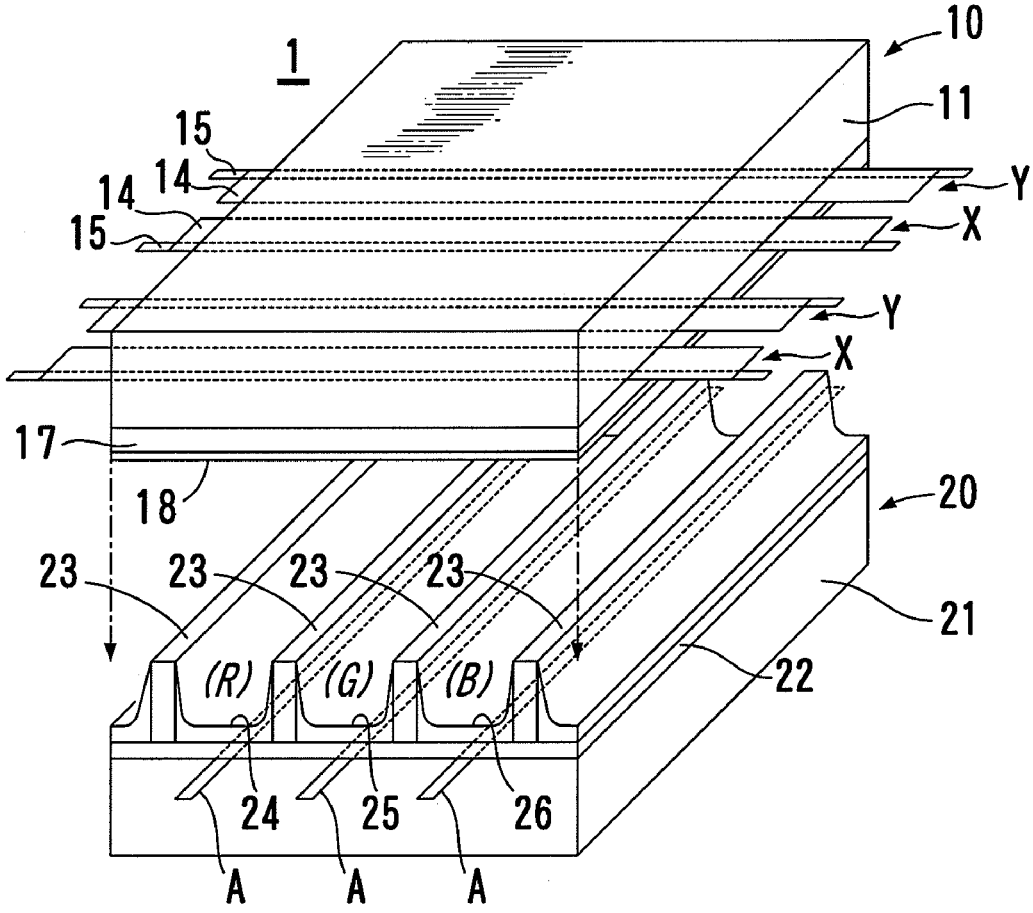
FIG. 1 PRIOR ART
FIG. 1 is an exploded perspective view showing a cell structure of a typical plasma display panel.

A preferred example of the present invention is a typical three-electrode surface discharge type plasma display panel shown in FIG. 1. However, without limiting to the three-electrode structure, a driving method of the present invention can be applied to other surface discharge type plasma display panels including a four-electrode structure having first, second and third row electrodes.

Figure 2:
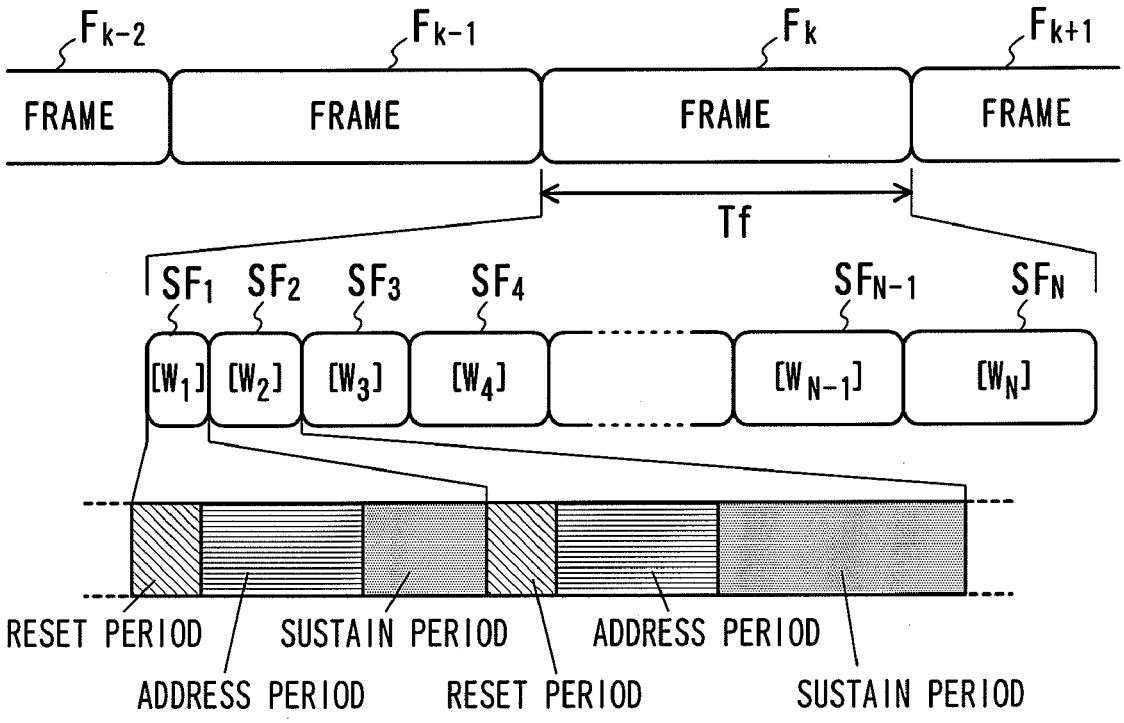
FIG. 2 PRIOR ART
FIG. 2 is a diagram showing an example of a frame division for reproducing gradation.
Figure 3:
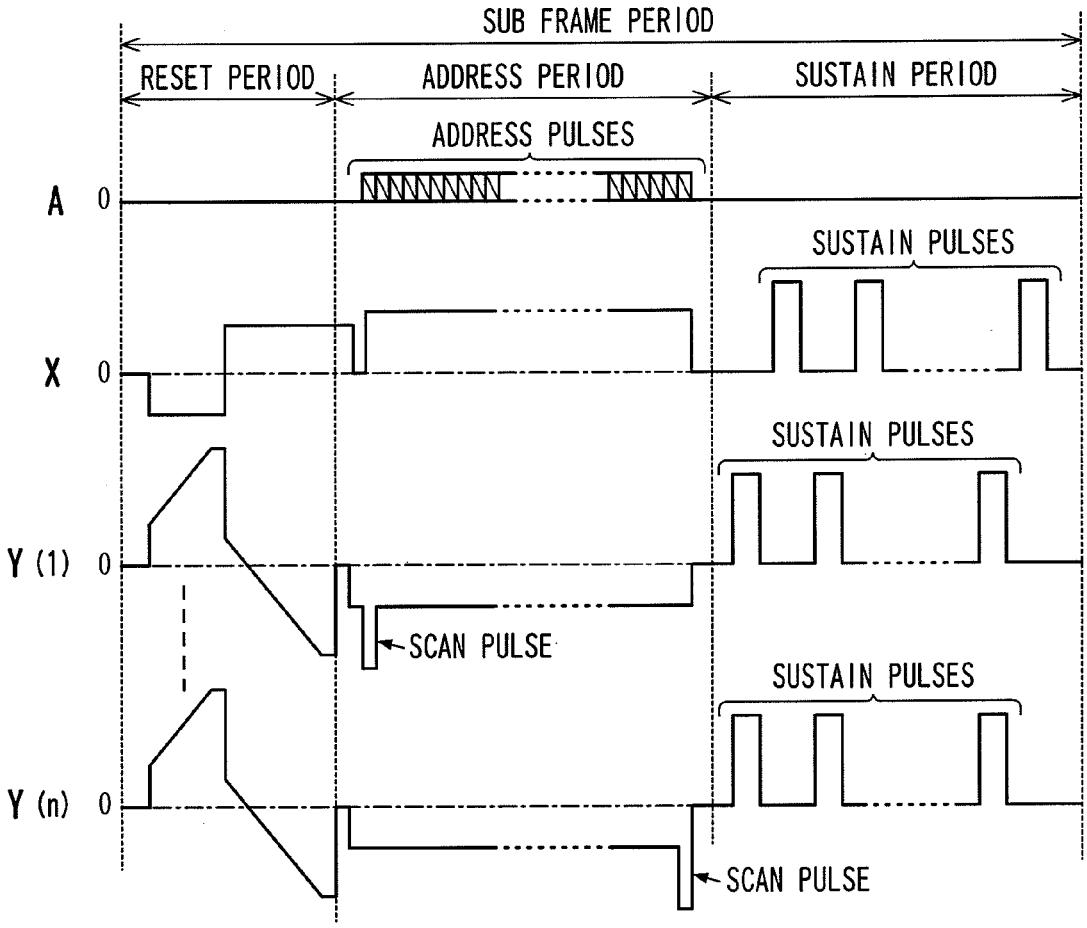
FIG. 3 PRIOR ART
FIG. 3 is a drive voltage waveform diagram showing a driving sequence including a conventional reset operation.

In addition, a method of replacing a frame F with a plurality of sub frames SF shown in FIG. 2 and a driving sequence repeating the reset, the addressing and the sustaining operations shown in FIG. 3 can be applied to the driving method of the present invention except setting of drive waveforms in a reset period.

In the following description, driving of the plasma display panel shown in FIG. 1 is exemplified. Correspondence between structural elements of the present invention and elements of the plasma display panel shown in FIG. 1 is as follows.

The first substrate corresponds to the glass substrate 11, and the second substrate corresponds to the glass substrate 21. The first electrode corresponds to the row electrode X, the second electrode corresponds to the row electrode Y, and the third electrode corresponds to the column electrode A. The first insulator corresponds to the protection film 18, and the second insulator corresponds to the fluorescent materials 24, 25 and 26.

FIRST EXAMPLE

With reference to FIG. 3, selection of a cell in the address period is performed by using the row electrode Y and the column electrode A, so the address discharge for the addressing is the opposed discharge naturally. Furthermore, the opposed discharge is the discharge with the row electrode Y being a cathode. It is because that if the row electrode Y is a cathode, the secondary electron emitting action of the protection film 18 contributes to the discharge. In order to perform the line sequential addressing at a high speed, it is advantageous to generate the opposed discharge with the row electrode Y being a cathode.

Purposes of the reset operation as a preprocess of the addressing operation is to cancel a binary set state of quantity of the wall charge formed in the previous addressing and to optimize wall charge quantity of every cell, so that the address discharge can be generated easily in the next addressing. In order to make the address discharge be generated easily, it is necessary that the discharge just before the address period should be the discharge having the same polarity as the address discharge. Since the scan pulse that is applied to the row electrode Y in the addressing operation has a negative polarity, the final discharge in the reset period is the discharge with the row electrode Y being a cathode. Furthermore, it is desirable that the final discharge should be the discharge starting from the opposed discharge for adjusting the wall charge precisely.

This example will be described more specifically with reference to a cell voltage plane.

Figure 4:
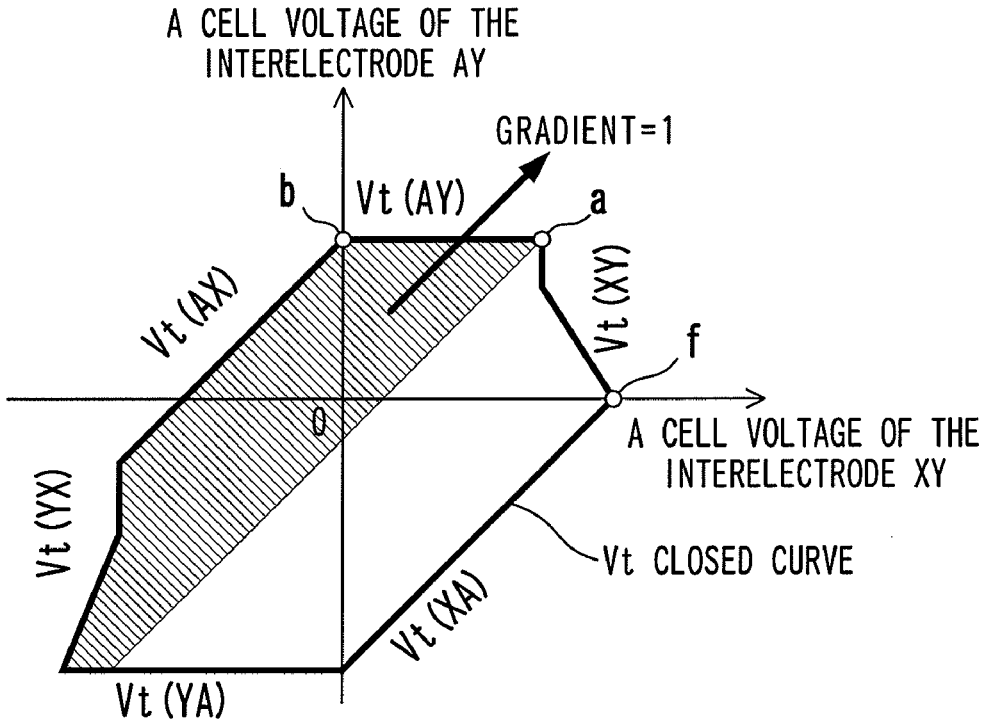
FIG. 4 is an explanatory diagram of requirements for a reset operation according to the present invention.

An operation of the plasma display panel having the three-electrode structure can be analyzed in a geometric manner with reference to a cell voltage plane and a discharge start threshold value closed curve as disclosed in the above-mentioned document. The cell voltage plane that is used here is a rectangular coordinate plane in which the horizontal axis is a cell voltage of the interelectrode XY while the vertical axis is a cell voltage of the interelectrode AY as shown in FIG. 4. The discharge start threshold value closed curve (hereinafter referred to as a Vt closed curve) is embodied by measuring discharge start threshold values (Vt) of the three interelectrodes XY, AY and AX and by plotting the values obtained from the measurement on the cell voltage plane. Vt is a minimum voltage that can generate the feeble discharge. In the measurement of the voltage Vt of a certain interelectrode, cell voltages of the other two interelectrodes are changed step by step. The measurement may be a real measurement or a simulation. Letters inside parentheses in FIG. 4 indicate the corresponding electrodes. The first letter indicates an anode while the last letter indicates a cathode.

The discharge with the row electrode Y being a cathode includes A-Y discharge that is the opposed discharge and X-Y discharge that is the surface discharge. In the expression of the "A-Y discharge" and the "X-Y discharge", the upper case letter before "-" (A or X) indicates an anode while the upper case letter after the same (Y) indicates a cathode. Hereinafter, a discharge start threshold value of the X-Y discharge is represented by Vt(XY), and a discharge start threshold value of the A-Y discharge is represented by Vt(AY). In addition, applying a voltage between an electrode and a reference potential line is expressed like "applying a voltage to an electrode" or "applying a pulse to an electrode" for convenience sake. As to the polarity of the obtuse wave pulse, a polarity that decreases electrode potential is referred to as a negative polarity while a polarity that increases electrode potential is referred to as a positive polarity.

When the obtuse wave pulse having a negative polarity is applied to the row electrode Y for generating the discharge with the row electrode Y being a cathode, potential of the row electrode X and potential of the column electrode A increase in the same manner relatively to potential of the row electrode Y. Therefore, the application is represented by a vector having a gradient "1" in the cell voltage plane as shown in FIG. 4 by the thick arrow. If this vector crosses the line connecting the points a and b on the Vt closed curve, the A-Y discharge is generated first. If it crosses the line connecting the points a and f, the X-Y discharge is generated first. Therefore, the condition of starting from the opposed discharge means that a position of a cell voltage before the application of the obtuse wave pulse having a negative polarity is located inside the Vt closed curve and in the region above the line with a gradient "1" passing the point a (the region with hatching in FIG. 4).

Figure 5:
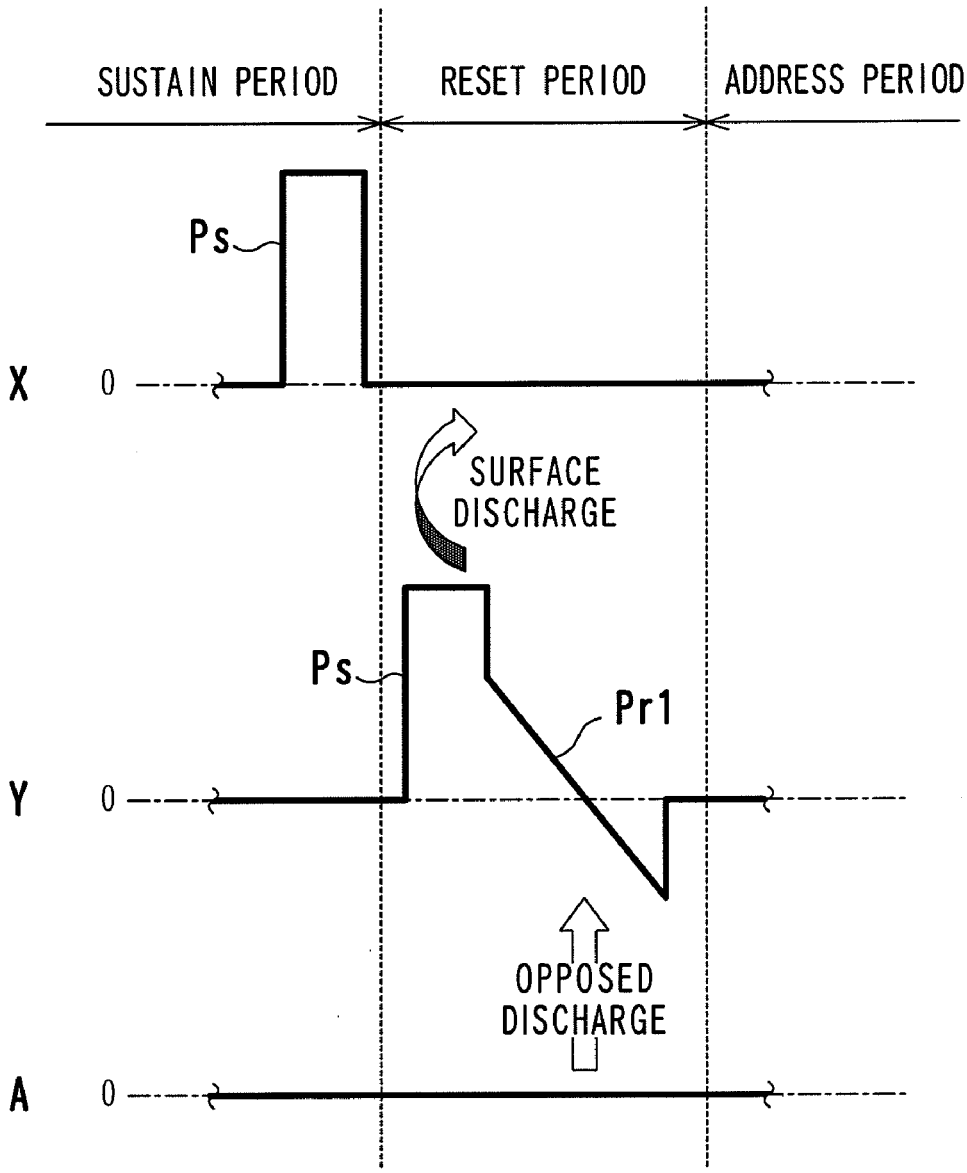
FIG. 5 is a drive waveform diagram of a reset operation according to a first example.

This first example satisfies the above-mentioned condition by applying a rectangular pulse prior to the application of the obtuse wave pulse having a negative polarity. As shown in FIG. 5, a sustain pulse Ps that is a rectangular pulse having a positive polarity is applied to the row electrode Y, so that the Y-X discharge that is the surface discharge is generated. After that, the obtuse wave pulse Pr1 having a negative polarity is applied to the row electrode Y so that the A-Y discharge that is the opposed discharge is generated. As apparent from the comparison with FIG. 3, the feature unique to the present invention different from the conventional driving method is maintaining potential of the row electrode X at the ground potential without increasing it when the obtuse wave pulse Pr1 having a negative polarity is applied.

In FIG. 5, the application of the sustain pulse Ps to the row electrode X is the last operation in the sustain period. However, it is possible to regard the application of the sustain pulse Ps to the row electrode Y as the last operation in the sustain period and to regard only the application of the obtuse wave pulse Pr1 having a negative polarity as an operation in the reset period.

SECOND EXAMPLE

Figure 6:
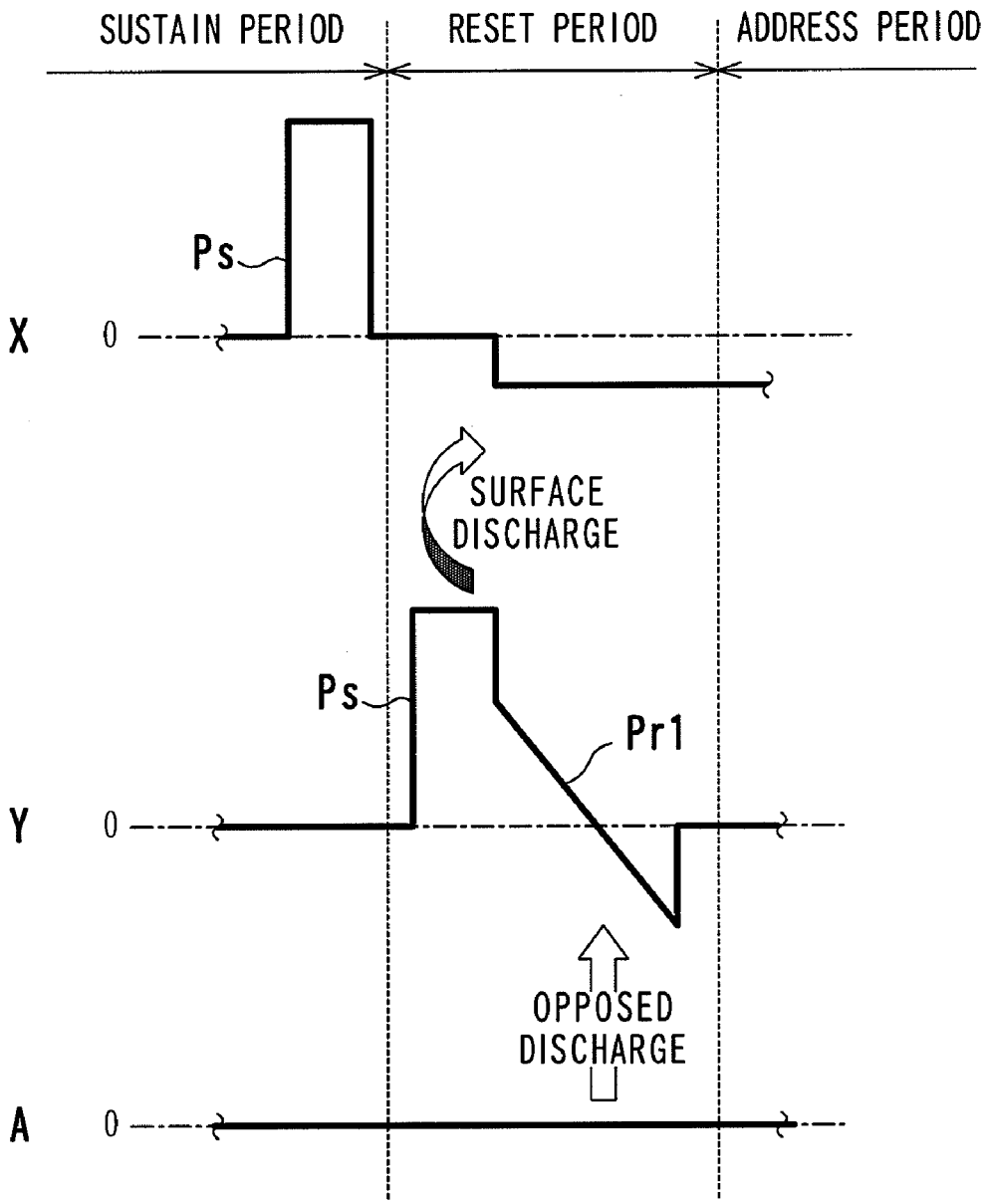
FIG. 6 is a drive waveform diagram of a reset operation according to a second example.

A second example is a variation of the first example. As shown in FIG. 6, the row electrode X is biased to negative potential so that potential of the row electrode X becomes close to potential of the row electrode Y during the period in which the obtuse wave pulse Pr1 having a negative polarity is applied.

Figure 7:
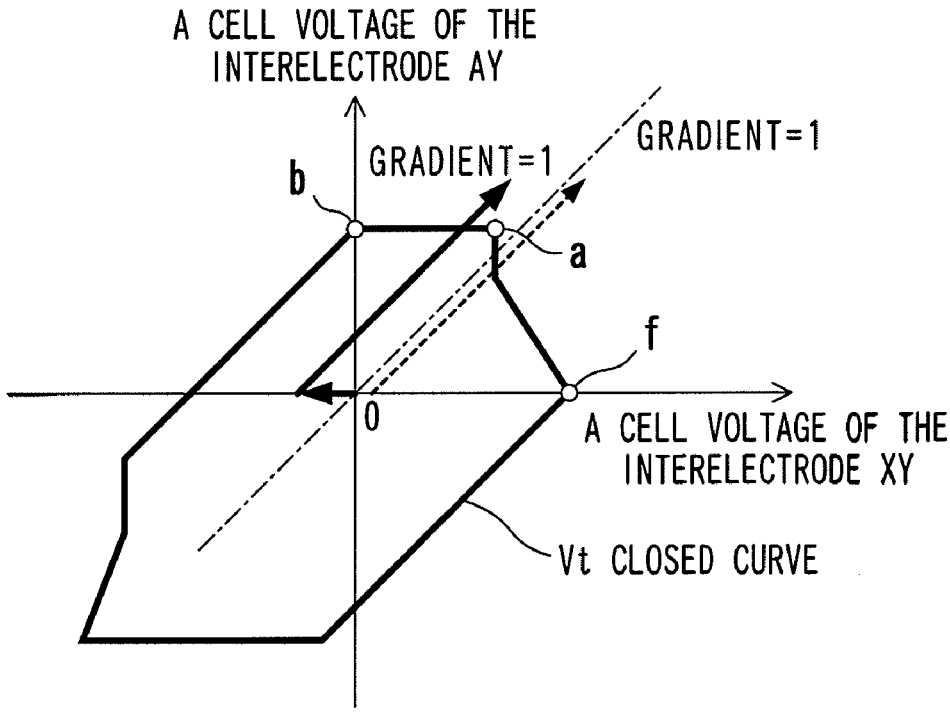
FIG. 7 is an explanatory diagram of the reset operation according to the second example.

According to this example, the charge adjustment discharge starting from the opposed discharge can be generated more securely. It is because that a start point of a vector having a gradient "1" corresponding to the obtuse wave pulse Pr1 having a negative polarity is shifted from the origin of the cell voltage plane toward the left (the negative side of the horizontal axis) by the bias of the row electrode X as shown in FIG. 7. This will be described in more detail.

Since the Y-X discharge in response to the sustain pulse Ps forms the wall charge that cancels an applied voltage, the state when the Y-X discharge is finished corresponds to the origin on the cell voltage plane ideally. However, there is the case where the state is shifted to the right from the origin because of some error actually. In this case, as shown in FIG. 7 by the arrow with a broken line, there is a possibility that the vector having a gradient "1" crosses the line connecting the points a and f. If the start point of the vector having a gradient "1" is shifted to the left, it is possible to make the vector cross the line connecting the points a and b. Also in the case where the point a is located on the left side of the straight line with the gradient "1" passing the origin (the dashed dotted line in FIG. 7), it is possible to generate the charge adjustment discharge starting from the opposed discharge by shifting the start point of the vector to the left.

In other words, tolerance of the cell state (the start point of the vector) when the application of the obtuse wave pulse Pr1 having a negative polarity is started as well as tolerance of a variation of the Vt closed curve is large in the second example.

THIRD EXAMPLE

Figure 8:
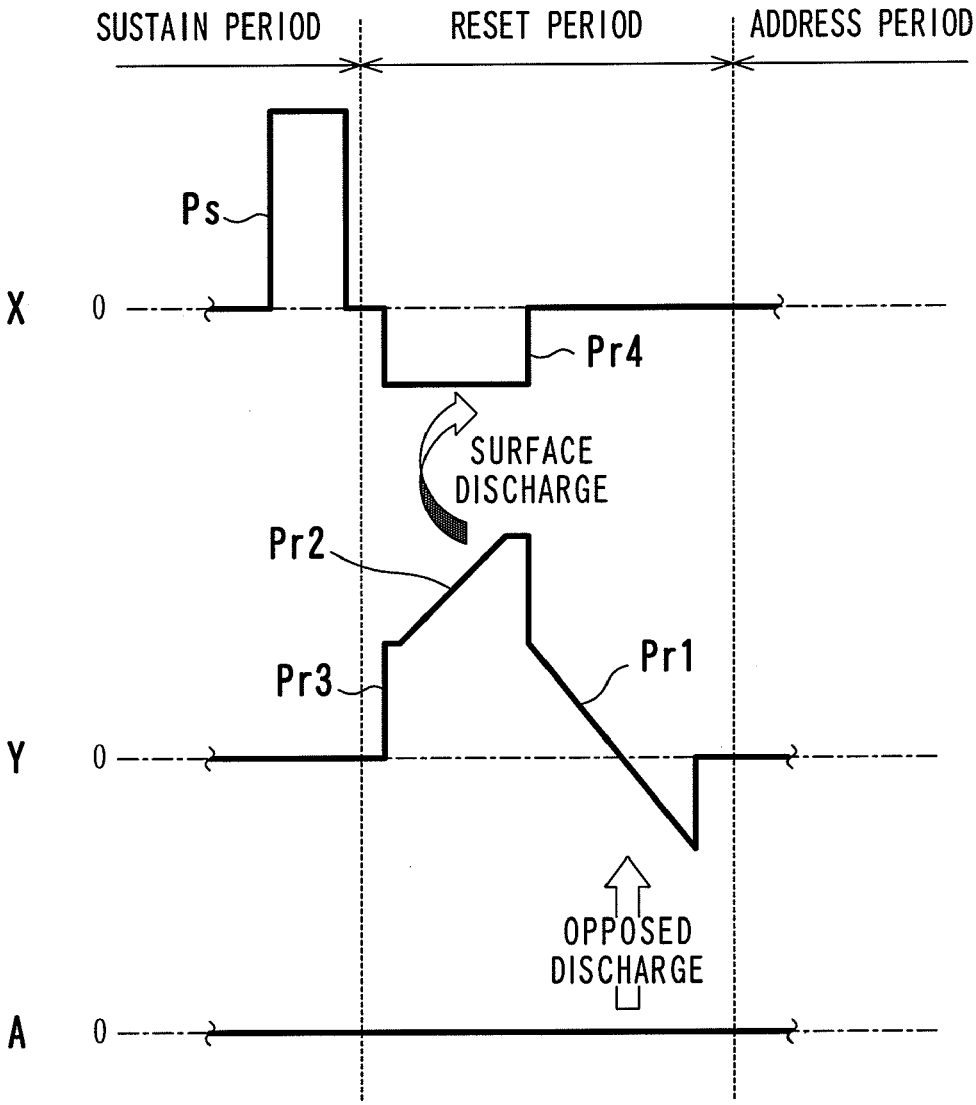
FIG. 8 is a drive waveform diagram of a reset operation according to a third example.

In a third example, application of the obtuse wave pulse is performed two times as the reset operation. As shown in FIG. 8, the obtuse wave pulse Pr2 having a positive polarity is applied to the row electrode Y prior to the application of the obtuse wave pulse Pr1 having a negative polarity. In order to advance a discharge start time, the obtuse wave pulse Pr2 is added to a rectangular wave offset pulse Pr3 having a positive polarity while a rectangular wave offset pulse Pr4 having a negative polarity is applied to the row electrode X. This application of the obtuse wave pulse Pr2 causes the Y-X discharge that is the surface discharge.

If the wall charge state just before the application of the obtuse wave pulse Pr1 in the reset period is uncertain, or if the wall charge quantity when the sustain period is finished is excessively large or small, it is necessary to generate discharge for charge adjustment before the application of the obtuse wave pulse Pr1. In this discharge, the row electrode Y must be an anode. The opposed discharge with the row electrode Y being an anode is unstable because of a small quantity of secondary electron emission as described above. Therefore, the surface discharge is generated before the application of the obtuse wave pulse Pr1.

Since the obtuse wave pulse Pr2 that generates the surface discharge has a positive polarity, the gradient can be steeper than the case where it has a negative polarity. However, it is necessary to prevent the surface discharge from being generated in the pre-extinguished cell. The waveform of the obtuse wave pulse Pr2 (including the gradient and the pulse width) is set so that the above-mentioned constraint can be satisfied. It is because that if the reset operation includes only two obtuse wave pulse application steps, the combination of the surface discharge and the surface discharge or the combination of the opposed discharge and the opposed discharge is necessary, so the driving sequence repeating the combination of the surface discharge and the opposed discharge will be unstable. For example, if a certain cell is not energized in a certain sub frame, neither the address discharge nor the display discharge is generated. Therefore, the discharge operation that is a combination of the surface discharge and the opposed discharge continues in the reset period of the current sub frame and in the reset period of the next sub frame. If the cell is energized, there is no problem because there is a display discharge operation between the reset operation and the next reset operation. If the surface discharge is not generated in the pre-extinguished cell during the reset period, the discharge operation that is a combination of the surface discharge and the opposed discharge does not continue.

FOURTH EXAMPLE

Figure 9:
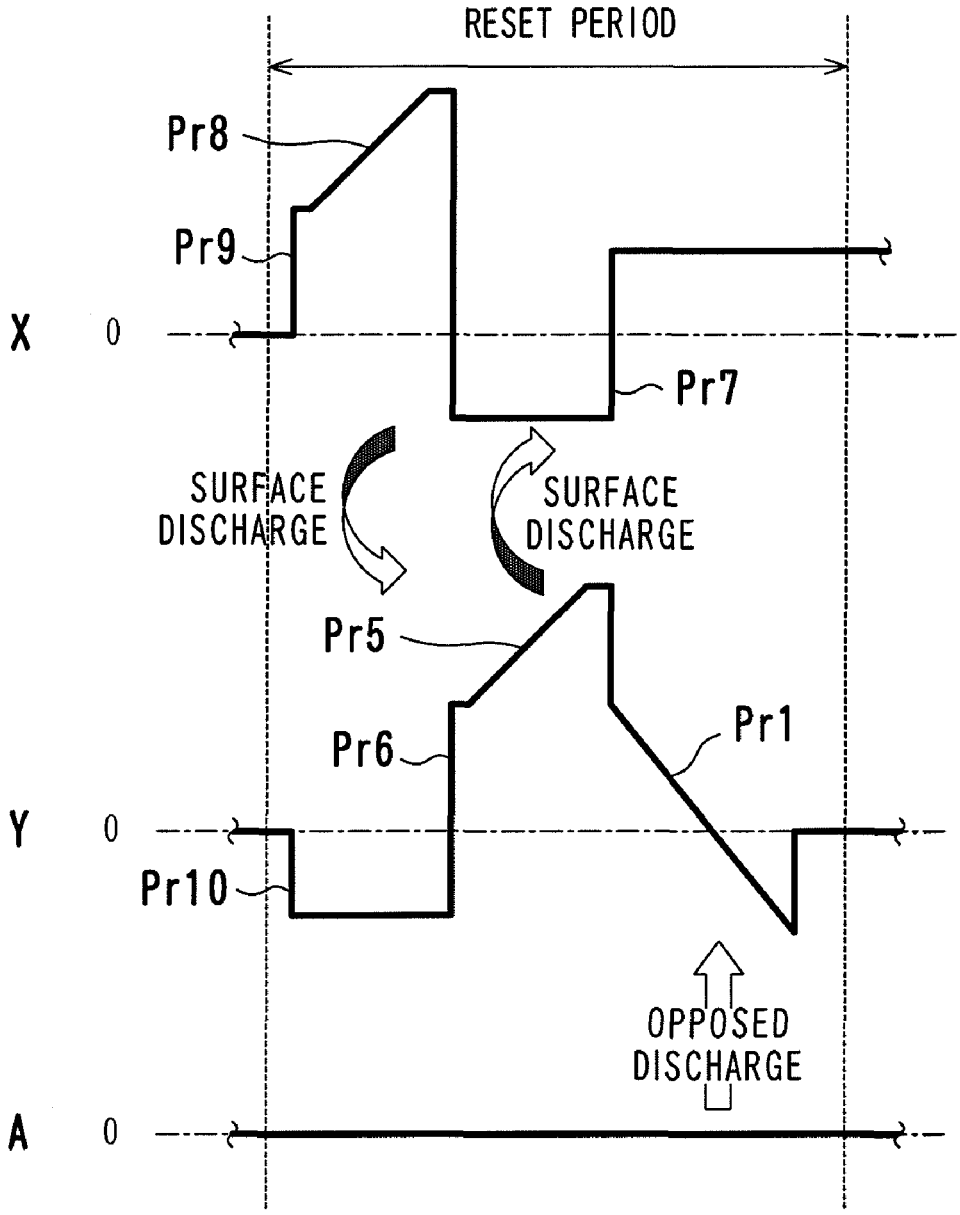
FIG. 9 is a drive waveform diagram of a reset operation according to a fourth example.

In a fourth example, application of the obtuse wave pulse is performed three times as the reset operation. If each cell is not in the state where the reset operation has been performed like the state just after the power is turned on, it is necessary to generate the charge adjustment discharge with the row electrode X being an anode before the surface discharge of the third example described above. As shown in FIG. 9, an obtuse wave pulse Pr5 having a positive polarity, a rectangular wave offset pulse Pr6 and a rectangular wave offset pulse Pr7 are applied prior to the application of the obtuse wave pulse Pr1 having a negative polarity similarly to the third example. However, in this example, potential of the row electrode X is increased when the obtuse wave pulse Pr1 having a negative polarity is applied. An obtuse wave pulse Pr8 having a positive polarity is applied to the row electrode X prior to the application of the obtuse wave pulse Pr1 having a negative polarity. In order to advance a discharge start time, the obtuse wave pulse Pr8 is added to a rectangular wave offset pulse Pr9 having a positive polarity while a rectangular wave offset pulse Pr10 having a negative polarity is applied to the row electrode Y. The application of the obtuse wave pulse Pr8 causes the X-Y discharge that is the surface discharge. Since the obtuse wave pulse Pr8 has a positive polarity, the gradient can be steeper than the case where it has a negative polarity.

Figure 10:
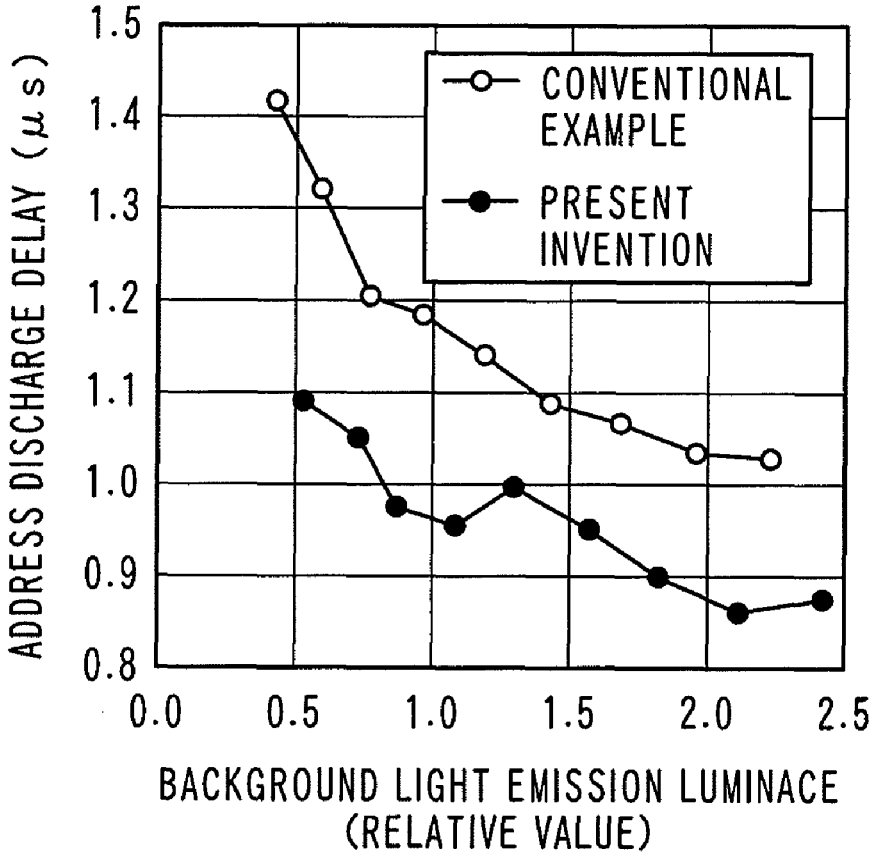
FIG. 10 is a diagram showing an effect of the fourth example.

FIG. 10 shows a relationship between a background light emission luminance and an address discharge delay in the fourth example. In FIG. 10, hollow circles indicate the case where the conventional reset shown in FIG. 3 was performed while black circles indicate the case where the reset of this fourth example was performed. The background light emission luminance depends on intensity of the discharge in the reset period. The background light emission luminance becomes higher as the intensity of the discharge in the reset period becomes higher. In order to enhance contrast of a display, it is desirable that the background light emission luminance should be low. The address discharge delay is a time period from leading edges of the scan pulse and the address pulse to the start of the address discharge. If the discharge delay is longer than the pulse widths of the scan pulse and the address pulse, the address discharge is not generated resulting in occurrence of a display defect. In order to speed up the addressing, i.e., to decrease the pulse widths of the scan pulse and the address pulse, it is desirable that the address discharge delay should be short. As a general tendency, the address discharge delay becomes shorter as the background light emission luminance becomes higher.

As apparent from FIG. 10, the reset operation in the fourth example is effective in reducing the address discharge delay. For example, if the background light emission luminance is 1.0, speed up of approximately 200 ns can be achieved compared with the conventional reset operation. In addition, from another viewpoint, the reset operation of the fourth example is effective in reducing the background light emission luminance. For example, if the address discharge delay is approximately 1.1 μs, the background light emission luminance can be reduced by approximately one third.

Figure 11:
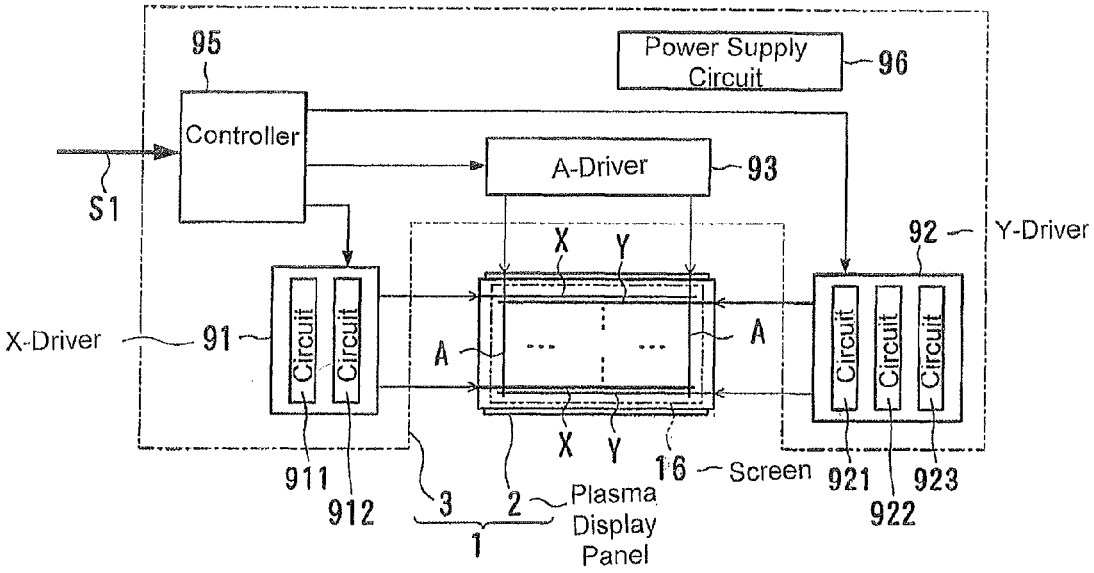
FIG. 11 is a diagram showing a structure of a display device according to the present invention.

The first to fourth examples can be carried out in the display device having the structure shown in FIG. 11.

In FIG. 11, a display device 1 includes a plasma display panel 2 of the three-electrode surface discharge AC type having a screen 16 that is capable of displaying color pictures and a driving circuit 3 for driving the plasma display panel 2.

The screen 16 of the plasma display panel 2 is a set of cells having the structure shown in FIG. 1. This screen 16 has the first row electrodes X and the second row electrodes Y arranged alternatively, and the column electrodes A that are arranged. On each row of the screen 16, the row electrode X and the row electrode Y constitute an electrode pair for generating sustain discharge of the surface discharge form. The column electrode A crosses the row electrode X and the row electrode Y in each of the cells belonging to the column where the column electrode A is disposed. Note that the arrangement of the row electrodes can be either one of two well-known forms in embodiments of the present invention. One of them is as shown in FIG. 1, in which the electrode gap between neighboring rows is larger than the electrode gap in each row (i.e., a surface discharge gap). The other arrangement has a uniform row electrode gap for all rows.

The driving circuit 3 includes an X-driver 91 for applying the drive voltage to the row electrodes X, a Y-driver 92 for applying the drive voltage to the row electrodes Y, an A-driver 93 for applying the drive voltage to the column electrodes A, a controller 95 for controlling application of the drive voltages to the plasma display panel 1, and a power supply circuit 96.

The X-driver 91 includes a circuit 911 for applying the sustain pulse and a circuit 912 for applying a pulse for the reset. The Y-driver 92 has a circuit 921 for applying the scan pulse, a circuit 922 for applying the sustain pulse, and a circuit 923 for applying a pulse for the reset.

The driving circuit 3 is supplied with a color picture signal S1 having a frame rate of 1/30 seconds from an image output device such as a TV tuner, a computer or the like. This color picture signal S1 is converted into sub frame data for display of a plasma display panel 8 by a data processing block of the controller 95.

In the embodiments described above, the waveforms, the voltages, the driving sequence, the device structures and the like can be modified within the scope of the present invention without deviating from the spirit thereof, if necessary. For example, the reset of the fourth example may be performed just after the power is turned on or at a set timing of a predetermined interval, and the other reset is performed in accordance with any one of the first to the third examples.

Industrial Applicability

The present invention can be used for a display device equipped with a surface discharge type plasma display panel, which includes a display of information processing equipment such as a personal computer or a workstation, a flat television set, a public display for advertisement or guide information.

The invention claimed is:

1. A method for driving a plasma display panel having cells of a surface discharge structure, the plasma display panel including a first substrate and a second substrate that sandwich a discharge gas space in between the first substrate and the second substrate, first electrodes and second electrodes both arranged on the first substrate, a first insulator intervening between the first electrode and the discharge gas space as well as between the second electrode and the discharge gas space, third electrodes arranged on the second substrate, and a second insulator intervening between the third electrode and the discharge gas space, the first insulator more readily emitting secondary electrons than the second insulator, the method comprising the steps of:

in an address period for forming a state where wall charge that is necessary for energizing a cell to be energized is accumulated, generating address discharge of an opposed discharge form with the second electrode used as a cathode between the second electrode and the third electrode in a cell to be energized or in a cell not to be energized;

in a sustain period for generating discharge between the first electrode and the second electrode in the cell to be energized where the state is formed in the address period, applying a sustain pulse that generates the discharge and has a positive polarity to the first electrode and the second electrode alternately, wherein the sustain pulse to be applied last during the sustain period is applied to the first electrode; and in a reset period for initializing the wall charge in the first insulator of every cell to which the sustain pulse is applied in the sustain period, applying a pulse having a positive polarity to the second electrode while applying, to the third electrode, a first voltage and applying, to the first electrode, a second voltage equal to or smaller than the first voltage so as to generate discharge of a surface discharge form between the first electrode and the second electrode, and subsequently applying an obtuse wave pulse having a negative polarity to the second electrode while applying, to the third electrode, a third voltage and applying, to the first electrode, a fourth voltage equal to or smaller than the third voltage so as to generate charge adjustment discharge starting from discharge of an opposed discharge form with the second electrode used as a cathode between the second electrode and the third electrode.

2. The method according to claim 1, wherein each of the first voltage, the second voltage, the third voltage, and the fourth voltage is 0 volts.

3. The method according to claim 1, wherein each of the first voltage, the second voltage, and the third voltage is 0 volts, and the fourth voltage is a negative voltage.

4. The method according to claim 1, wherein each of the first voltage, the third voltage, and the fourth voltage is 0 volts, and the second voltage is a negative voltage.

5. A display device comprising:

a plasma display panel having cells of a surface discharge structure; and a driving circuit for driving the plasma display panel, the plasma display panel including a first substrate and a second substrate that sandwich a discharge gas space in between the first substrate and the second substrate, first electrodes and second electrodes both arranged on the first substrate, a first insulator intervening between the first electrode and the discharge gas space as well as between the second electrode and the discharge gas space, third electrodes arranged on the second substrate, and a second insulator intervening between the third electrode and the discharge gas space, the first insulator more readily emitting secondary electrons than the second insulator, wherein the driving circuit generates, in an address period for forming a state where wall charge that is necessary for energizing a cell to be energized in accumulated, address discharge of an opposed discharge form with the second electrode used as a cathode between the second electrode and the third electrode in a cell to be energized or in a cell not to be energized, the driving circuit applies, in a sustain period for generating discharge between the first electrode and the second electrode in the cell to be energized where the state is formed in the address period, a sustain pulse that generates the discharge and has a positive polarity to the first electrode and the second electrode alternately, wherein the sustain pulse to be applied last during the sustain period is applied to the first electrode, and the driving circuit applies, in a reset period for initializing the wall charge in the first insulator of every cell to which the sustain pulse is applied in the sustain period, a pulse having a positive polarity to the second electrode while applying, to the third electrode, a first voltage and applying, to the first electrode, a second voltage equal to or smaller than the first voltage so as to generate discharge of a surface discharge form between the first electrode and the second electrode, and subsequently applies an obtuse wave pulse having a negative polarity to the second electrode while applying, to the third electrode, a third voltage and applies, to the first electrode, a fourth voltage equal to or smaller than the third voltage so as to generate charge adjustment discharge starting from discharge of an opposed discharge form with the second electrode used as a cathode between the second electrode and the third electrode.

6. The display device according to claim 5, wherein each of the first voltage, the second voltage, the third voltage, and the fourth voltage is 0 volts.

7. The display device according to claim 5, wherein each of the first voltage, the second voltage, and the third voltage is 0 volts, and the fourth voltage is a negative voltage.

8. The display device according to claim 5, wherein each of the first voltage, the third voltage, and the fourth voltage is 0 volts, and the second voltage is a negative voltage.

9. A method for driving a plasma display panel having cells of a surface discharge structure, the plasma display panel including a first substrate and a second substrate that sandwich a discharge gas space in between the first substrate and the second substrate, first electrodes and second electrodes both arranged on the first substrate, a first insulator intervening between the first electrode and the discharge gas space as well as between the second electrode and the discharge gas space, third electrodes arranged on the second substrate, and a second insulator intervening between the third electrode and the discharge gas space, the first insulator more readily emitting gas space, the first insulator more readily emitting secondary electrons than the second insulator, the method comprising the steps of:

in an address period for forming a state where wall charge that is necessary for energizing a cell to be energized is accumulated, generating address discharge of an opposed discharge form with the second electrode used as a cathode between the second electrode and the third electrode in a cell to be energized or in a cell not to be energized;

in a sustain period for generating discharge between the first electrode and the second electrode in the cell to be energized where the state is formed in the address period, applying a sustain pulse that generates the discharge and has a positive polarity to the first electrode and the second electrode alternately, wherein the sustain pulse to be applied last during the sustain period is applied to the first electrode; and in a reset period for initializing the wall charge in the first insulator of every cell to which the sustain pulse is applied in the sustain period, applying a pulse having a positive polarity to the second electrode while applying, to the third electrode, a first voltage and applying, to the first electrode, a second voltage smaller than the first voltage so as to generate discharge of a surface discharge form between the first electrode and the second electrode, and subsequently applying an obtuse wave pulse having a negative polarity to the second electrode while applying, to the third electrode, a third voltage and applying, to the first electrode, a fourth voltage equal to or smaller than the third voltage so as to generate charge adjustment discharge starting from discharge of an opposed discharge form with the second electrode used as a cathode between the second electrode and the third electrode.

* * * * *